United States Patent [19]

Sugarman

[11] 4,428,571

[45] Jan. 31, 1984

[54] LIMB POSITIONING DEVICE

[76] Inventor: Edward D. Sugarman, 6726 Gleason Pl., Fayetteville, N.Y. 13066

[21] Appl. No.: 264,081

[22] Filed: May 15, 1981

[51] Int. Cl.[3] ..... A61G 13/00

[52] U.S. Cl. ..... 269/328

[58] Field of Search ..... 269/328, 75, 45; 5/443, 5/444; 128/80 R, 133, 134; 403/90, 76, 77, 56

[56] References Cited

U.S. PATENT DOCUMENTS

| | | | |
|---|---|---|---|
| 358,513 | 3/1887 | Walton | 269/328 |
| 456,891 | 7/1891 | Fish | 269/45 |
| 541,863 | 7/1895 | Loomis | 269/328 |
| 979,091 | 12/1910 | Pickart | 5/443 |
| 988,923 | 4/1911 | Bauerfeind | 5/443 |
| 1,323,127 | 11/1919 | Treuthardt | 269/95 |
| 1,446,811 | 2/1923 | Rowland | 269/45 |
| 1,516,795 | 11/1924 | Schwarting | 5/443 |
| 2,057,992 | 10/1936 | Wiruth | 269/328 |
| 2,067,891 | 1/1937 | Comper | 269/328 |
| 2,614,558 | 10/1952 | Lovell | 269/328 |
| 2,850,342 | 9/1958 | Robinson | 269/328 |
| 3,710,783 | 1/1973 | Jasalevich | 269/328 |
| 3,810,462 | 5/1974 | Szpur | 269/322 |
| 4,103,625 | 8/1978 | Black | 269/328 |
| 4,253,649 | 3/1981 | Hewsen | 269/45 |

FOREIGN PATENT DOCUMENTS

| | | | |
|---|---|---|---|
| 823556 | 9/1969 | Canada | 269/328 |

*Primary Examiner*—Robert C. Watson

*Attorney, Agent, or Firm*—Burns & Jenney

[57] ABSTRACT

An autoclavable device for mechanically holding a limb, particularly the leg, in the optimum position for performing surgery thereon. The device includes a central support member having an outwardly projecting rod for detachably securing the support member to an operating table. The device also includes an upwardly extending arm that is pivotally connected to the central support member and is adapted to engage the leg on one side or the other of the knee. An extension member in the form of an elongated rod is connected to the central support by means of a ball joint to permit angular adjustment of the rod with respect to the support. Adjustably mounted on the extension member rod is a U-shaped member adapted to engage the lower extremity of the leg in the area of the ankle. A handle is provided at the outer end of the extension member rod to facilitate adjusting the angular position of the rod and thus of the lower extremity of the leg.

2 Claims, 6 Drawing Figures

LIMB POSITIONING DEVICE

BACKGROUND OF THE INVENTION

This invention relates generally to surgical appliances, and has particular reference to a novel limb positioning device for use with an operating table. The device is designed to mechanically hold the limb, particularly the leg, in the optimum position for performing surgery thereon. While not so limited, the limb positioning device of the invention is especially advantageous in performing knee surgery.

The various surgical procedures performed on the knee usually require a variety of positions to allow access to the different areas of the joint. There is need for firm support of the lower extremity. Frequently this support is rendered by an assistant who must assume an uncomfortable position and maintain it with only minor changes for long periods of time.

With the development of arthorscopy and arthroscopic surgery, there is a need for definite reliability in the positioning and holding of the lower limb. The surgical instruments used are capable of damage to the knee joints just as they are curative in their prime function. They include knives, power instruments, biopsy forceps and scissors. The positions of the knee that are required include flexion, extension, rotation and abduction as well as adduction of the knee, and combinations of all of these.

In smaller hospitals where personnel are not always available to help in the surgical theatre, there is great need for a reliable means to hold the leg and maintain varying degrees of pressure in all positions. In addition, the surgeon must be able to easily adjust the positioning device without destroying its sterile condition. Reliability, sterility, variability and ease of operation are all requirements for any lower extremity support system.

In addition to its use in the newer types of surgical procedures, a leg holding or support device must be adaptable to the older and more routine surgical procedures to greatly expand its usefullness. The device described hereinafter also has the ability to allow varus and valgus positioning with the weight of the leg aiding in the maintenance of position.

A number of limb holding or supporting devices have been developed heretofore for use in surgical procedures. Some of these operate on a tourniquet principle which may not always be desirable. Others of the devices are limited as to adjustability or variability, and some are not as reliable as required. Prior U.S. patents that disclose leg positioning devices are U.S. Pat. Nos. 2,057,992; 2,119,325 and 2,267,924. Other patents developed in the course of a preliminary search are U.S. Pat. Nos. 473,200; 988,923; 1,266,367; 2,801,142; 3,339,913; 3,528,413 and 3,810,462.

SUMMARY OF THE INVENTION

The limb positioning device of the invention is made of stainless steel whereby it can be autoclaved and used in the sterile field. It supports the lower extremity and provides the opportunity for the surgeon to position and hold the knee in any position firmly and without assistance. It allows repositioning the lower extremity and locking it in place which allows the surgeon to perform arthroscopy (both diagnostic and operative), menisectomies, total knee surgeries, synovectomies and release of the patella laterally; also exploration of the knee for diagnosis and various other procedures currently requiring more than one surgeon and assistant. This saving of personnel creates a reduced economic load for the hospital and the patient, and does not decrease the quality of care. It actually enhances and causes the procedure to be safer; while an assistant may tire or move, the unit will not.

The leg positioning device disclosed herein is for use with an operating table having a fitting for the attachment of accessories, and comprises a central support member having an outwardly extending rod that is engageable with the fitting. The device also includes an upwardly extending arm that is pivotally connected to the central support member and is adapted to engage the leg on one side or the other of the knee. An extension member in the form of an elongated rod is connected to the central support by means of a ball joint to permit angular adjustment of the rod with respect to the support. Adjustably mounted on the extension member rod is a U-shaped member adapted to engage the lower extremity of the leg in the area of the ankle. A handle is provided at the outer end of the extension member rod to facilitate adjusting the angular position of the rod and thus of the lower extremity of the leg.

The positioning device provides a rigid platform for the knee in extension, flexion, varus, valgus, internal and external rotation and in combinations of these positions. Thus, the knee may be held in any position for visualization of the medical meniscus or in flexion, external rotation and cross table position for visualization of the lateral compartment of the knee. The device does not have any tourniquet effect although a tourniquet may be used with the device if the surgeon wishes it.

A surgeon can position and hold the knee and lower extremity without additional help. In the case of open fractures to the tibia, and of those that require open rod reduction and internal fixation, the patient's foot may be attached to the foot holding clamp and held in position for appropriate fixation, decreasing further injury to the leg and enhancing the ability of the surgeon to preserve uninjured soft tissue and bone.

DESCRIPTION OF THE PREFERRED EMBODIMENTS

Figure 1:
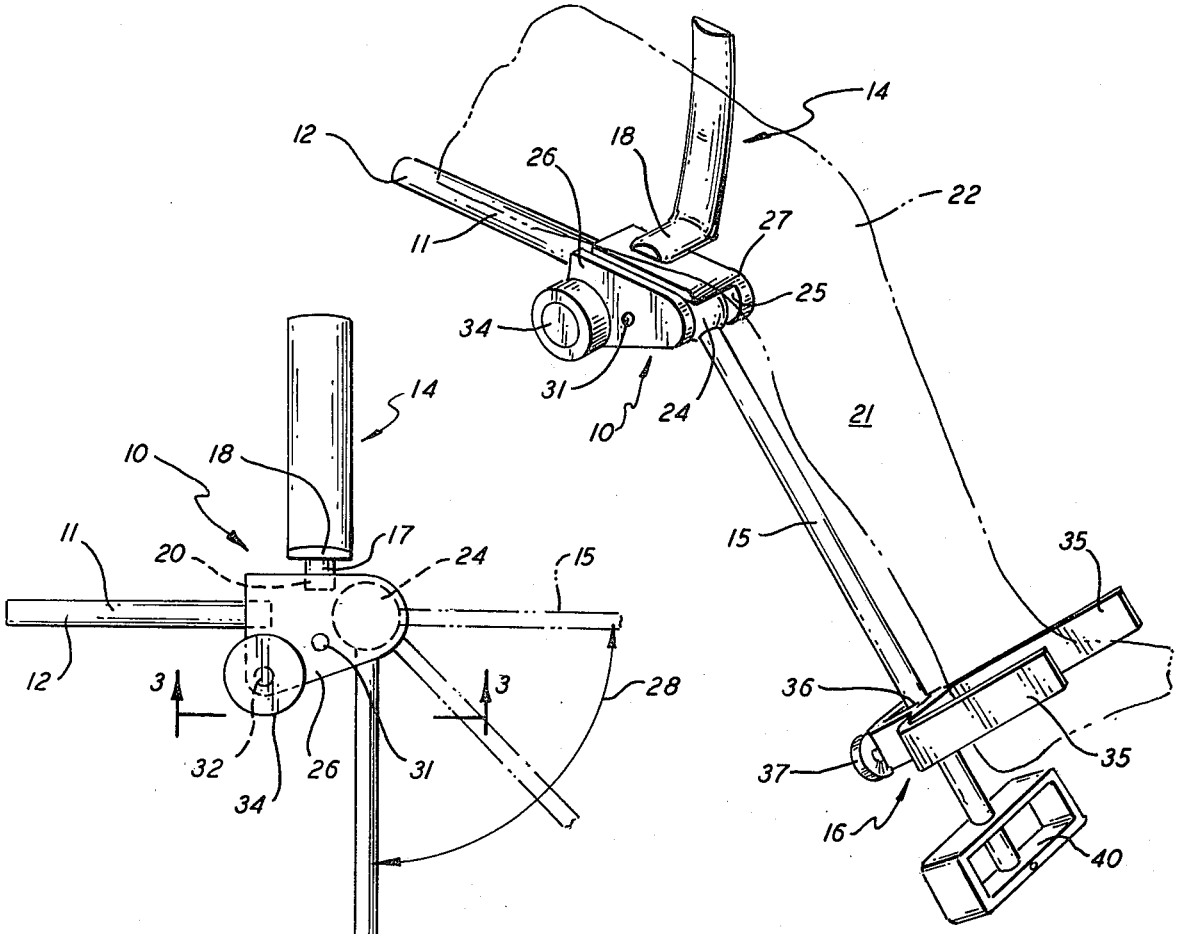
FIG. 1 is a perspective view of a limb positioning device embodying the invention, a portion of the leg being shown in phantom lines.
Figure 2:
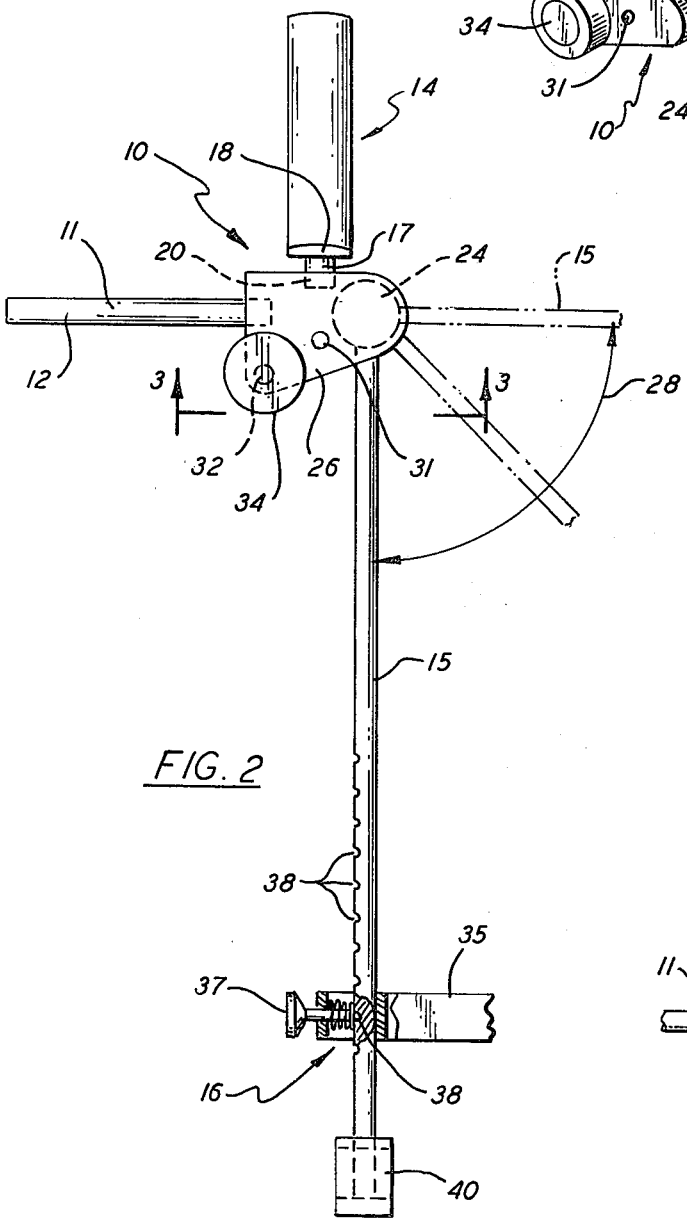
FIG. 2 is a side elevation of the device of FIG. 1.
Figure 3:
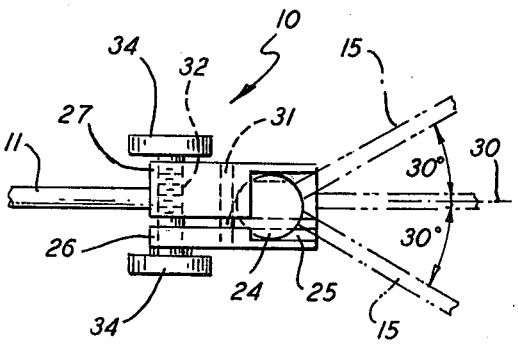
FIG. 3 is a bottom plan view of the central support member of the device, looking in the direction of arrows 3—3 on FIG. 2.

Referring now to the drawings, and with particular reference to FIGS. 1–3, the limb positioning device includes a central support member generally indicated at 10 and a rod 11 that is rigidly secured to the support member and extends outwardly therefrom as shown. The free end 12 of the rod is adapted to be firmly clamped in a standard fitting (not shown) on the operating table with which the positioning device is being used. The device also includes an upstanding limb engaging member generally indicated at 14 that is pivotally mounted on the central support member, and an elongated extension member 15 that is connected to the support member so that its position can be angularly adjusted with respect thereto. All of these components, as well as a second limb engaging member 16 to be described, are fabricated from stainless steel so that the device is autoclavable.

The limb engaging member 14 is generally L-shaped and includes a shank 17, FIG. 2, that depends from the underside of its horizontal leg 18. The shank 17 is journalled in a bore 20 in the central support member 10 and can pivot through at least 180° to engage either side of the knee as will be explained in more detail hereinafter. For the purpose of the disclosure, the leg 21 of a patient is shown in phantom lines in FIG. 1 with the knee being at 22.

The extension member 15 is, in the embodiment of FIGS. 1–3, an elongated rod that is connected to the central support member 10 through a ball joint. The ball joint comprises a ball 24 fixed on the inner end of the rod and a socket 25 formed by conforming recesses in the central support. The support is formed of two parts 26 and 27, and there is a recess in each of these that conforms to a portion of the spherical surface of the ball 24.

The front and underside of the support member 10 are cut away in the area of the ball joint to permit angular adjustment of the extension member rod 15. Thus, the rod can move through 90° in a vertical plane as indicated by the arrow 28 in FIG. 2, or from a horizontal position as shown in phantom lines to a vertical position as shown in solid lines. The ball joint also permits lateral adjustment of the rod of up to 30° on either side of a central position 30, FIG. 3, that lies in a vertical plane through the oppositely extending rod 11, FIGS. 1 and 3.

The two parts 26 and 27 of the central support member 10 are connected together by a guide pin 31 and a threaded shaft 32, FIG. 3, the shaft having a knurled turning knob 34 at each end. By turning either knob in one direction the parts of the support member can be tightened on the ball 24 to rigidly secure the extension member rod 15 in a desired position of adjustment. Conversely, the knobs can be turned in the opposite direction to loosen the engagement of the parts 26,27 with the ball and permit the rod to be moved to a new position of adjustment.

The second limb engaging member 16, mentioned above, is mounted on the extension member rod 15 and comprises a substantially U-shaped, spring steel bracket having outwardly projecting legs 35. The member 16 is adapted to engage the lower extremity of the patient's leg in the area of the ankle. To this end, the position of member 16 is adjustable on the rod 15, the rod passing with a sliding fit through a bore 36 in the bracket member. Member 16 can be releasably secured in any one of a plurality of positions along the rod by a spring biased detent 37 that is engageable with any of a plurality of recesses 38 formed in the rod.

In order to permit adjustment of the extension member 15 without destroying the sterile condition of the positioning device, a handle 40 is provided on the outer end of the extension member rod as shown in FIG. 1.

Figure 5:
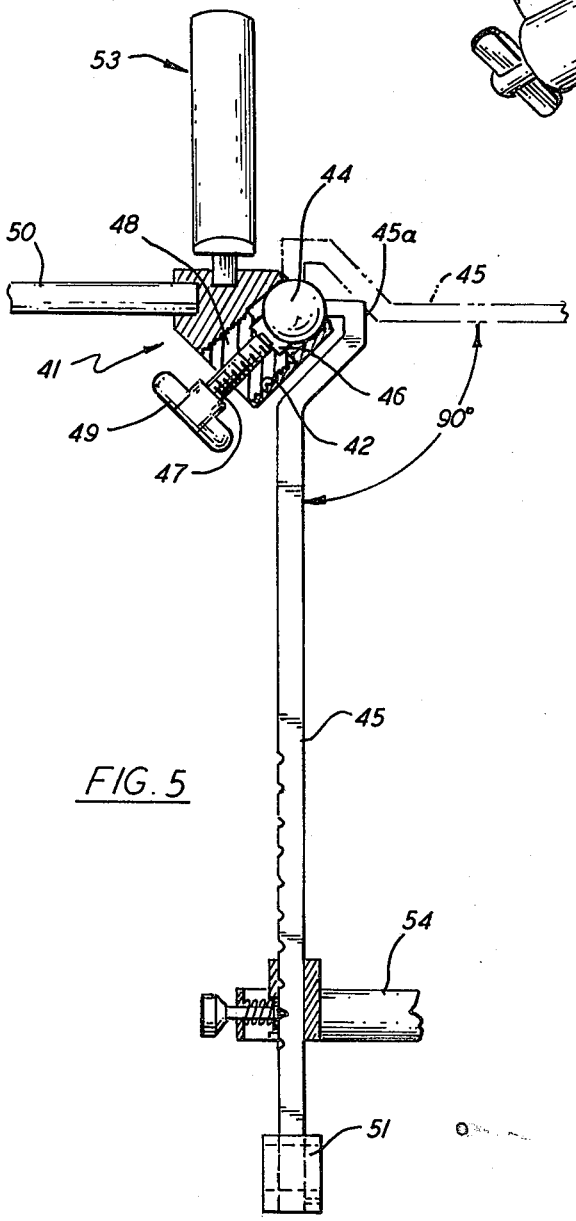
FIG. 5 is a side elevation of the device of FIG. 4.
Figure 4:
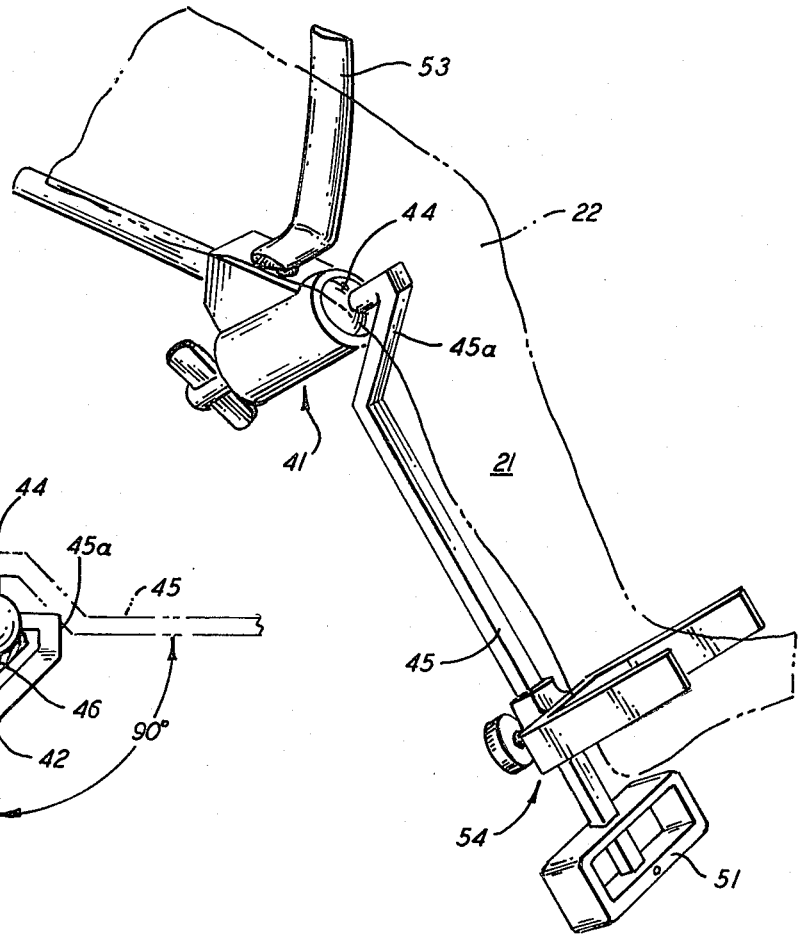
FIG. 4 is a perspective view corresponding to FIG. 1 but showing a modified form of the limb positioning device.
Figure 6:
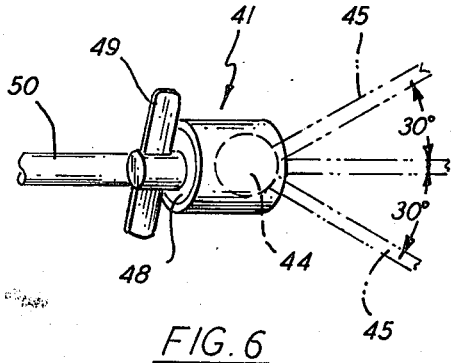
FIG. 6 is a bottom perspective view of the ball joint portion of the central support member with the adjustment clamping means being shown.

FIGS. 4–6 disclose a modified form of the limb positioning device of the invention. This form differs from that of FIGS. 1–3 primarily in that the central support member 41 is a one piece component having an obliquely disposed bore 42 extending therethrough. The upper end of this bore forms a socket for a ball 44 fixed on the inner end of an extension member rod 45 that corresponds to extension member 15 of FIGS. 1–3 except that member 45 has a square cross section throughout its length as best shown in FIG. 4.

The upper end of the bore 42 is swaged or spun inwardly to retain the ball 44 in the bore. The lower part of the ball is engaged by a pad 46 on the inner end of a shaft 47 that is threaded into a plug 48 fixed in the lower part of bore 42. At its outer end, the threaded shaft has a handle 49 by which the pad 46 can be moved into tight engagement with ball 44 to rigidly secure the extension member 45 in a desired position of adjustment, or it can be moved in the opposite direction to permit a new adjustment.

As in the modification of FIGS. 1–3, extension member 45 can be adjusted through 90° in a vertical plane and laterally up to 30° on either side of a central position as indicated in FIG. 6. In order to permit the member 45 to be moved into a vertical position as shown in FIG. 1, its upper end is formed with an angular offset portion **45*a*, this construction being necessitated by the angular disposition of bore 42**.

In the form of the invention disclosed in FIGS. 4–6, the rod 50 for securing the device to the operating table, the extension member handle 51 and the first and second limb engaging members 53 and 54 are essentially the same as the corresponding parts in FIGS. 1–3.

In using the device, and with particular reference to FIGS. 1 and 4, the device is first attached by rod 11 or 50 to the operating table fitting. In the case of surgical or diagnostic procedures involving the knee, the patient's leg would be positioned in the limb positioning device essentially as shown in the drawings. Thus, the lower femur would rest on the top of the central support member 10 or 41 and the tibia would be in line with extension member 15 or 45. The lower leg would be held in this position of alignment by the ankle engaging bracket 16 or 54, the position of the bracket on the extension member having been adjusted for the length of the patient's lower leg.

With the patient's leg so positioned in the device, the surgeon can place the knee in the position he wishes by angularly adjusting the position of the extension member up or down or laterally in either direction. The upstanding portion of the limb engaging member 14 or 53 normally coacts with the extension member in that it can be positioned against either the lateral or medial thigh to serve as a fulcrum against which the leg is pressed to open or close the medial or lateral knee joint as required.

From the foregoing description it will be apparent that the invention provides a novel and very advantageous limb positioning device. As will be apparent to those familiar with the art, the invention may be embodied in other specific forms without departing from the spirit or essential characteristics thereof.

I claim:

1. A leg positioning device for use with an operating table having a fitting for the attachment of accessories, a central support member, a rod fixed to the support member and extending outwardly therefrom for engagement with the fitting, a first, generally L-shaped limb engaging member the horizontal leg of which is pivotally connected to the support member for pivotal movement relative thereto, the vertical leg of the limb engaging member operating as a fulcrum that is engageable with the leg on one side or the other of the knee, an extension member in the form of an elongated rod movably connected at one end to the support member, the rod being connected to the support member by a ball joint to permit angular adjustment of the rod with respect to the support member, means on the support member to releasably hold the extension member rod in the position of desired adjustment, and a second limb engaging member adjustably mounted on the extension member rod, the second limb engaging member being movable into any one of a plurality of predetermined positions along the rod and being adapted to engage the lower extremity of the leg in the area of the ankle.

2. A leg positioning device as defined in claim 1 together with a handle at the outer end of the extension member to facilitate adjusting the angular position of the member.

* * * * *